US005983435A

United States Patent [19]

Osborne

[11] Patent Number: 5,983,435

[45] Date of Patent: Nov. 16, 1999

[54] BATHING IMPLEMENT

[75] Inventor: James J. Osborne, Ambler, Pa.

[73] Assignee: Verve Ltd, LLC, Spring House, Pa.

[21] Appl. No.: 09/135,690

[22] Filed: Aug. 18, 1998

Related U.S. Application Data

[60] Provisional application No. 60/064,932, Nov. 7, 1997.

[51] Int. Cl.[6] ..... A47L 13/10; A47L 17/08

[52] U.S. Cl. ..... 15/209.1; 15/229.11; 15/229.13; D28/63; D32/40

[58] Field of Search ..... 15/209.1, 229.11, 15/229.12, 229.13; D28/63; D32/40, 43

[56] References Cited

U.S. PATENT DOCUMENTS

| | | | |
|---|---|---|---|
| D. 351,285 | 10/1994 | Joyner | D32/40 |
| 1,047,703 | 12/1912 | Rapson | 15/209.1 |
| 1,963,529 | 6/1934 | Protz | 15/229.12 |
| 2,581,779 | 1/1952 | Abraham | 15/229.11 |
| 3,281,884 | 11/1966 | Feil . | |
| 3,336,618 | 8/1967 | Day . | |
| 3,345,668 | 10/1967 | Forrest . | |
| 4,199,835 | 4/1980 | Heyer et al. . | |
| 4,462,135 | 7/1984 | Sanford | 15/209.1 |
| 5,144,744 | 9/1992 | Campagnoli . | |
| 5,465,452 | 11/1995 | Girardot | 15/209.1 |
| 5,650,384 | 7/1997 | Gordon | 15/209.1 |
| 5,727,278 | 3/1998 | Per-Lee | 15/229.11 |
| 5,787,542 | 8/1998 | Chien | 15/209.1 |

*Primary Examiner*—Randall E. Chin
*Attorney, Agent, or Firm*—Howson and Howson

[57] ABSTRACT

A bathing implement for use in cleansing and exfoliating skin which can also be utilized as a bath toy by a child or an adult. The bathing implement includes a washcloth component and a collar component which attaches about a portion of the washcloth so that at least one end portion of the washcloth flares outwardly from the collar. Preferably, the washcloth is a flexible mesh sponge and the collar is sleeve-shaped and made of foam or any number of other materials.

13 Claims, 3 Drawing Sheets

BATHING IMPLEMENT

This application claims benefit of provisional Ser. No. 60,064,932 filed Nov. 7, 1997.

FIELD OF THE INVENTION

The present invention relates to a bathing implement for use during a bath or shower, and more particularly, the present invention relates to a washcloth type of implement which is useful with soap to cleanse and exfoliate skin, and which includes decorative features so that it can be used as a bath toy.

BACKGROUND OF THE INVENTION

Most people utilize their hands, or a washcloth, to lather soap and apply the lathered soap to the body during bathing. More recently, sponges, netting or mesh material have been utilized as washcloths since they also provide an exfoliation function. Common mesh sponges are normally provided in a substantially ball-like shape and include a string which enables the sponges to be hung until further use.

A common problem experienced with children, particularly young children, is that they often dislike bathing. One solution to this problem is the use of bath toys which help make a bath more enjoyable for the child. Another common problem is that young children often do not apply, or find it difficult to apply, a sufficient amount of lathered soap on their own to their bodies.

Although known washcloths, particularly washcloths intended for use by children, may be satisfactory for their intended purposes, there is a need for an improved bathing implement which can be used with a soap product to clean and exfoliate skin and which is useful as a bath toy to make bathing fun and easy for young children.

OBJECTS OF THE INVENTION

With the foregoing in mind, a primary object of the present invention is to provide a bathing sponge which can be used by children and adults in a practical manner to cleanse and exfoliate skin, and in a playful manner as a toy.

Another object of the present invention is to provide a bathing implement which can be readily and effectively used by children, which can be easily grasped by the hand of a young child, and which is readily stored and dried by hanging it in the shower when not in use.

A still further object of the present invention is to provide a bathing implement and bath novelty item/toy which provides an aesthetically pleasing bathing-area decoration so that a child-inviting atmosphere is created.

SUMMARY OF THE INVENTION

More specifically, the present invention provides a bathing implement which comprises a washcloth, mesh sponge, or the like, and a collar which attaches about a portion of the washcloth so that one or both end portions of the washcloth flare outwardly from the collar. The washcloth is used during a bath or shower to apply lather to cleanse and/or exfoliate the skin of the bather. The collar enables the bathing implement to be utilized as a bath toy, particularly if the collar has decorative features, such as the face of a popular children's character.

BRIEF DESCRIPTION OF THE DRAWINGS

The foregoing and other objects, features and advantages of the present invention should become apparent from the following description when taken in conjunction with the accompanying drawings, in which.

DETAILED DESCRIPTION OF THE PREFERRED EMBODIMENT

Figure 2:
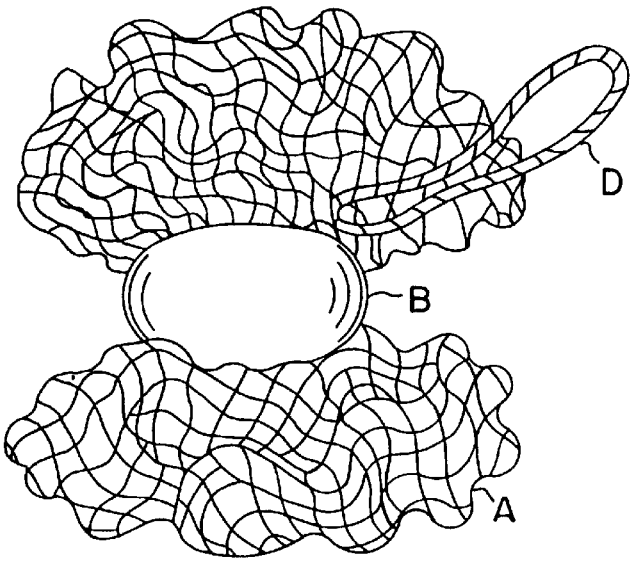
FIG. 2 is an elevational view of an assembled bathing implement embodying the present invention.

FIG. 2 illustrates a bathing implement embodying the present invention. The bathing implement includes a washcloth component, A, and a collar component, B. The washcloth component, A, can be any type of, but not limited to, sponge, mesh, netting, terry cloth, PVA, cotton or like material, but is preferably a mesh sponge having a flexible ball-like shape and a string, D, for hanging the mesh sponge. The collar component, B, can be made of, but not limited to, foam, plastic, PU, rubber, Rotocast, PVC, terry cloth, or like material. Preferably, the collar, B, is ring-shaped, or sleeve-shaped, and has a central hollow channel, C.

Figure 1:
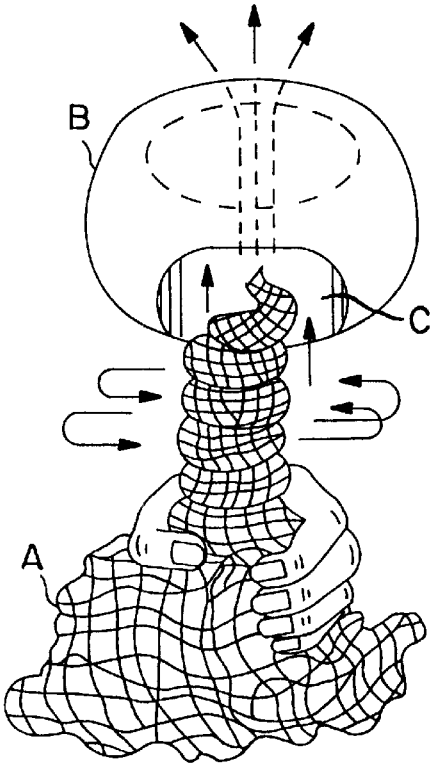
FIG. 1 is a perspective exploded view of an unassembled bathing implement according to the present invention.

As illustrated in FIG. 1, and by way of example, the bathing implement can be assembled by manipulating one end of the mesh sponge, A, through the channel, C, in the collar, B, until the collar is located about a medial portion of the sponge so that the opposite end portions of the sponge flare outwardly from opposite sides of the collar. The collar, B, is maintained in position about the medial portion of the sponge, A, by the opposite end portions of the sponge which regain their expanded shape on opposite sides of the collar. The elasticity of the collar, B, also enables the collar to maintain its position on the sponge, A. Other methods of assembly, such as would be practiced in an automated assembly line, can be utilized.

Figure 3A:
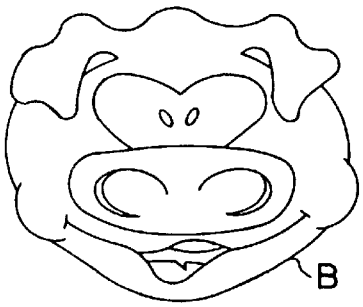
FIG. 3A is a front elevational view of the collar portion of the present invention.
Figure 3B:
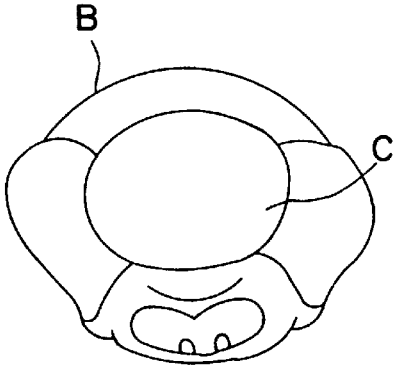
FIG. 3B is a top plan view of the collar illustrated in FIG. 3A.

As illustrated in FIGS. 3A and 3B, the collar, B, can be formed to provide decorative features which may be particularly attractive to young children. For instance, as illustrated, the collar is provided with a face of a pig. Alternatively, the collar could be molded to embody any other decorative feature which may be aesthetically pleasing to a child or an adult. For example, the collar could be molded in the shape of a popular children's cartoon character, or it could be molded in the shape of a football, baseball, or any other shape.

Figure 4A:
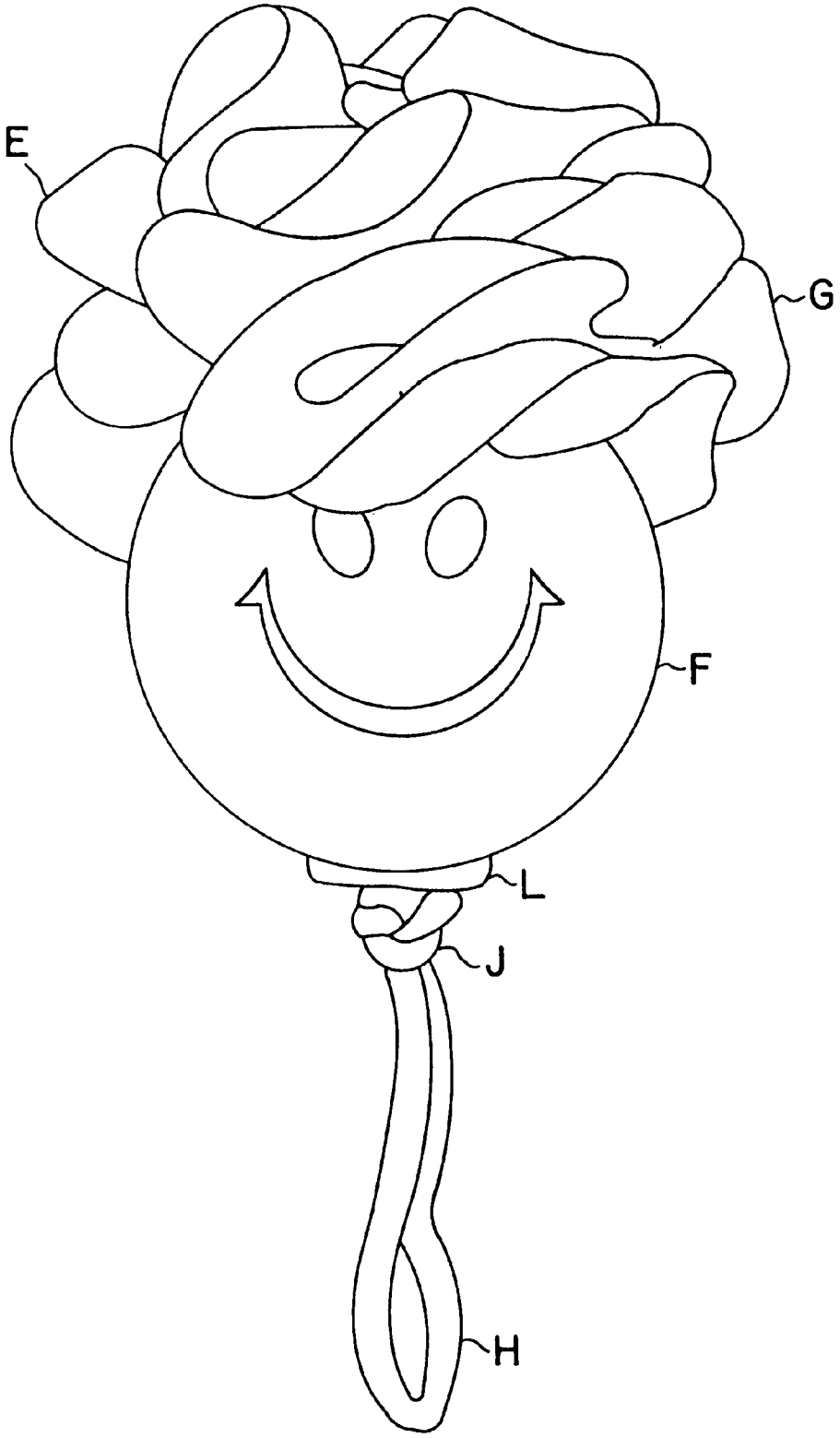
FIG. 4A is a front elevational view of an alternative embodiment of a bathing implement/novelty item according to the present invention.

An alternative embodiment of the present invention is the bathing implement, E, illustrated in FIG. 4A. A collar, F, attaches about one end portion of a washcloth, such as a mesh sponge, G, so that the opposite end portion of the mesh sponge flares outwardly from the collar. As illustrated, the collar, F, has a happy face design, and the one end portion of the mesh sponge, G, which flares outwardly from the collar, F, provides the appearance of hair extending from the top of the happy face. Other designs, shapes, and materials can be utilized, and various means of attaching the washcloth to the collar can be utilized.

Figure 4B:
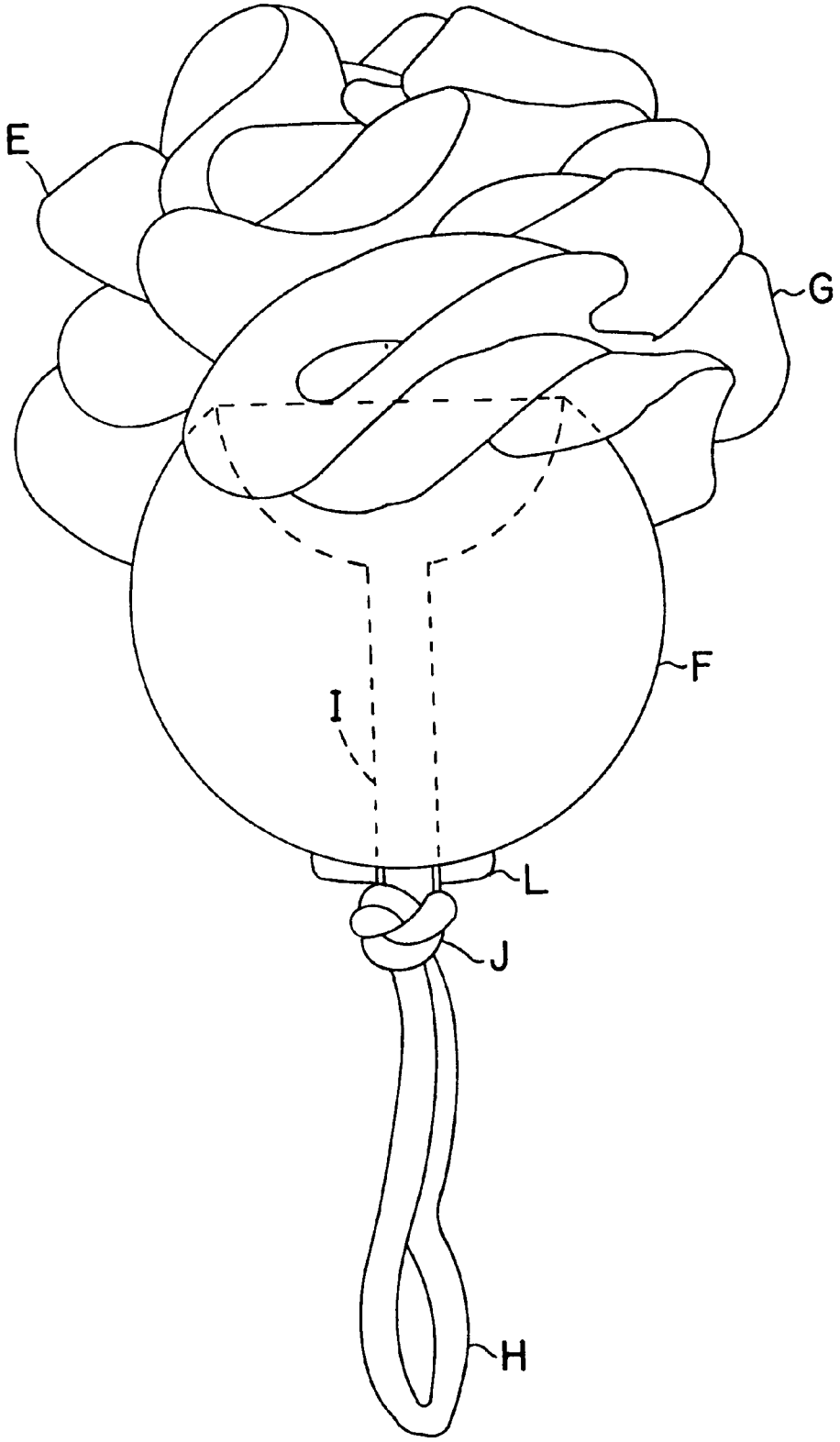
FIG. 4B is a partial cross-sectional view of the bathing implement/novelty item of FIG. 4A with an inner portion of the collar illustrated in dashed lines.

One example of a means to connect the sponge, G, to the collar, F, is illustrated in FIG. 4B. To this end, the mesh sponge, G, is provided with a cord, H, and the collar, F, is provided with an inner channel, I. The cord, H, is extended through the channel, I, and is formed into a knot, J, to attach the mesh sponge, G, to the collar, F. Preferably, a washer, L, is located between the knot, J, and collar, F, to prevent the knot from extending through the channel. The channel, 1, as shown, can be provided with a widened portion, K, so that one end of the mesh sponge, G, extends within the collar F. Alternatively, the entire mesh sponge can extend exteriorly of the collar. Other means to connect the washcloth to the collar can be utilized.

Thus, the bathing implement according to the present invention provides a cleansing sponge and a toy. As a toy, the bathing implement can be tossed or floated on the surface of the bath water, and it can be submerged and allowed to pop up out of the bath water. The collar can be provided with the shape or face of a character which is particularly appealing to the specific bather. As a sponge, the bathing implement can be used with or without a soap product to cleanse and exfoliate the skin. Furthermore, the sponge is abrasive enough to dislodge dirt and grime from the body of the bather, yet at the same time, the sponge is soft enough to be used on sensitive skin. In addition, children can have their own personalized sponge for use during bathtime which will create in the children a greater awareness of cleanliness and of the need to throughly wash their bodies. Finally, the invention is not limited to use by children; rather, different sized and shaped bathing implements can be used to accommodate adults.

While preferred and alternate bathing implements have been described in detail, various modifications, alterations, and changes may be made without departing from the spirit and scope of the present invention as defined in the appended claims.

I claim:

1. A bathing implement comprising:

a washcloth capable of applying lather to cleanse a bather; and a collar capable of attachment about a portion of said washcloth so that at least one end portion of said washcloth flares outwardly from said collar;

wherein said collar has a hollow channel formed therein which permits a portion of said washcloth to be inserted through said channel; and wherein a decorative design is formed on said collar; whereby said collar enables said bathing implement to be utilized as a bath toy.

2. A bathing implement according to claim 1, wherein said collar attaches about a medial portion of said washcloth so that opposite end portions of said washcloth flare outwardly from said collar.

3. A bathing implement according to claim 1, wherein said washcloth is a mesh sponge made of a net-like material.

4. A bathing implement according to claim 3, wherein said mesh sponge has a ball-like shape and has a string for hanging the mesh sponge.

5. A bathing implement according to claim 1, wherein said collar is made of a foam-like material.

6. A bathing implement according to claim 1, wherein said collar is sleeve-shaped and removable from said washcloth.

7. A bathing implement for use by a child during a bath, comprising:

a mesh sponge capable of applying lather to cleanse and exfoliate the skin of a child during a bath; and a sleeve-shaped, collar capable of attachment about a medial portion of said mesh sponge so that opposite end portions of said mesh sponge flare outwardly from said collar, said collar being of a material which is more rigid than said mesh sponge and having an outer surface of a size capable of being readily grasped so that said mesh sponge is capable of being manipulated when said collar is grasped; and wherein a decorative design is formed on said collar whereby said collar enables said bathing implement to be utilized as a bath toy and the relative rigidity and size of said collar enhances gripability and manipulation of the bathing implement.

8. A bathing implement comprising:

a washcloth having a cord extending therefrom; and a collar capable of attachment to said washcloth so that said washcloth flares outwardly from only one side of said collar, said collar having a hollow channel formed therein which said cord can be inserted through and knotted to connect said washcloth to said collar;

wherein said hollow channel has a widened portion adjacent said washcloth so that one portion of the washcloth is located within said collar and the remaining portion of the washcloth flares outwardly from said collar; whereby said collar enables said bathing implement to be utilized as a bath toy.

9. A bathing implement according to claim 8, wherein said washcloth is a mesh sponge.

10. A bathing implement according to claim 9, wherein said collar has a decorative design formed thereon.

11. A bathing implement comprising:

a washcloth having a cord extending therefrom, a collar capable of attachment to said washcloth so that said washcloth flares outwardly from only one side of said collar, said collar having a hollow channel formed therein which said cord can be inserted through and knotted to connect said washcloth to said collar, and a washer located about said cord between said knot and said collar; whereby said collar enables said bathing implement to be utilized as a bath toy.

12. A hand-held implement, comprising:

a washcloth; and a collar capable of attachment about a portion of said washcloth so that at least one end portion of said washcloth flares outwardly from said collar, said collar being of a material which is more rigid than said washcloth and having an outer surface of a size capable of being readily grasped by a user such that the user can manipulate the washcloth by grasping said collar and wherein a decorative design is formed on said collar.

13. A hand-held implement according to claim 12, wherein said collar is sleeve-shaped and removable from said washcloth.

* * * * *